US006135032A

United States Patent [19]

Ko

[11] Patent Number: 6,135,032

[45] Date of Patent: Oct. 24, 2000

[54] COMPUTER DESK HAVING ASCENDIBLE AND DESCENDIBLE DESK TOPS

[76] Inventor: Wen-Shan Ko, P.O. Box 23-487, Changhua City 500, Taiwan

[21] Appl. No.: 09/289,735

[22] Filed: Apr. 12, 1999

[30] Foreign Application Priority Data

Jan. 22, 1999 [TW] Taiwan ..... 88201054

[51] Int. Cl.[7] ..... A47B 57/00

[52] U.S. Cl. ..... 108/96; 108/147.21

[58] Field of Search ..... 108/96, 106, 147.19, 108/147.21, 146, 144.11

[56] References Cited

U.S. PATENT DOCUMENTS 63,633 4/1867 Haworth ..... 108/4

2,368,748 2/1945 Doty ..... 108/147.19

5,224,429 7/1993 Borgman et al. ..... 108/50.02

5,752,449 5/1998 Simon et al. ..... 108/50.02

*Primary Examiner*—Peter M. Cuomo

*Assistant Examiner*—Jerry A. Anderson

[57] ABSTRACT

A computer desk comprises two support frames similar in construction to each other, an ascendible and descendible main desk top supported by the support frames, and an ascendible and descendible auxiliary desk top supported by the two support frames. The support frames are formed of a base tube, two support tubes, two movable support rods, a fitting member, a retaining member, an adjustment shaft, and an adjustment shaft, and an adjustment knob. The main desk top and the auxiliary desk top are mounted on the top ends of the movable support rods which can be raised or lowered by turning the adjustment knob clockwise or counterclockwise.

6 Claims, 11 Drawing Sheets

COMPUTER DESK HAVING ASCENDIBLE AND DESCENDIBLE DESK TOPS

FILED OF THE INVENTION

The present invention relates generally to a computer desk, and more particularly to a computer desk having ascendible and descendible desk tops to suit persons of various sizes.

BACKGROUND OF THE INVENTION

The conventional computer desks have a fixed desk top which can not be adjusted in height to suit persons of various sizes. In addition, the conventional computer desks are generally rather complicated in construction and are therefore not cost-effective.

Certain conventional computer desks have a desk top which can be adjusted in height; nevertheless they are heavy and complicated in construction. Furthermore, they are not provided with a setting which conforms to the mechanics of human body for preventing the fatigue of users of the desks.

SUMMARY OF THE INVENTION

It is therefore the primary objective of the present invention to provide a computer desk which is simple in construction and cost-effective.

It is another objective of the present invention to provide a computer desk which has two desk tops adjustable in height to suit users of various sizes.

It is still another objective of the present invention to provide a computer desk with a setting which conforms to the mechanics of human body so as to afford a user of the computer desk a seating comfort.

In keeping with the principle of the present invention, the foregoing objectives of the present invention are attained by a computer desk comprising two support frames, a main desk top, an auxiliary desk top, and a keyboard support. Each of the two support frames is composed of a base tube, two support tubes, two movable support rods, two elastic pieces, a fitting member, a retaining member, an adjustment shaft, two locating bolts, and an adjustment knob. The main desk top and the auxiliary desk top are mounted on the top ends of the movable support rods of the two support frames such that the main desk top and the auxiliary desk top can be adjusted in height. The keyboard support is intended to keep the keyboard of the computer which is not in use, so as to enable the computer desk to be used as an ordinary desk.

The foregoing objectives, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
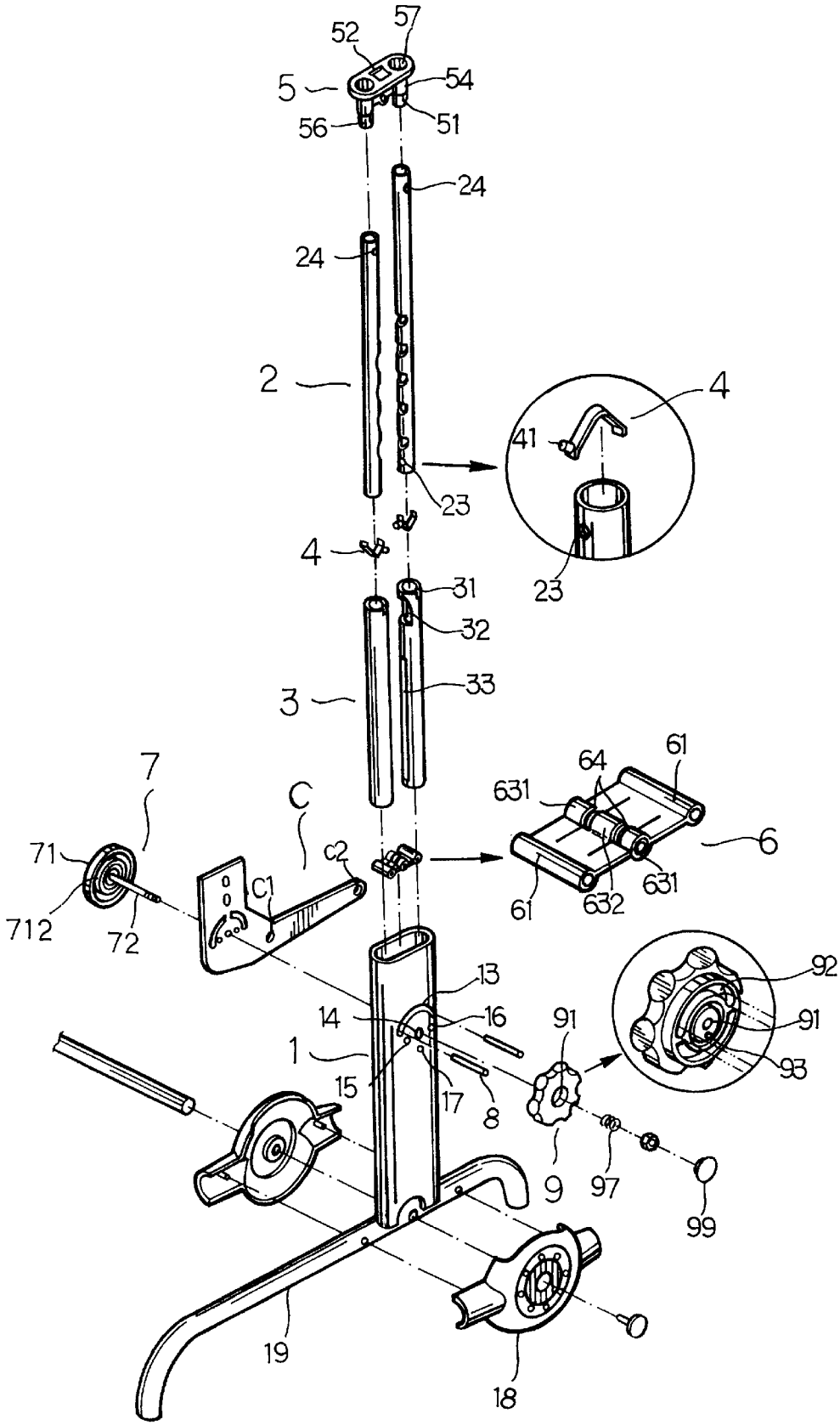
FIG. 1 shows an exploded view of the support frame of the present invention.
Figure 2:
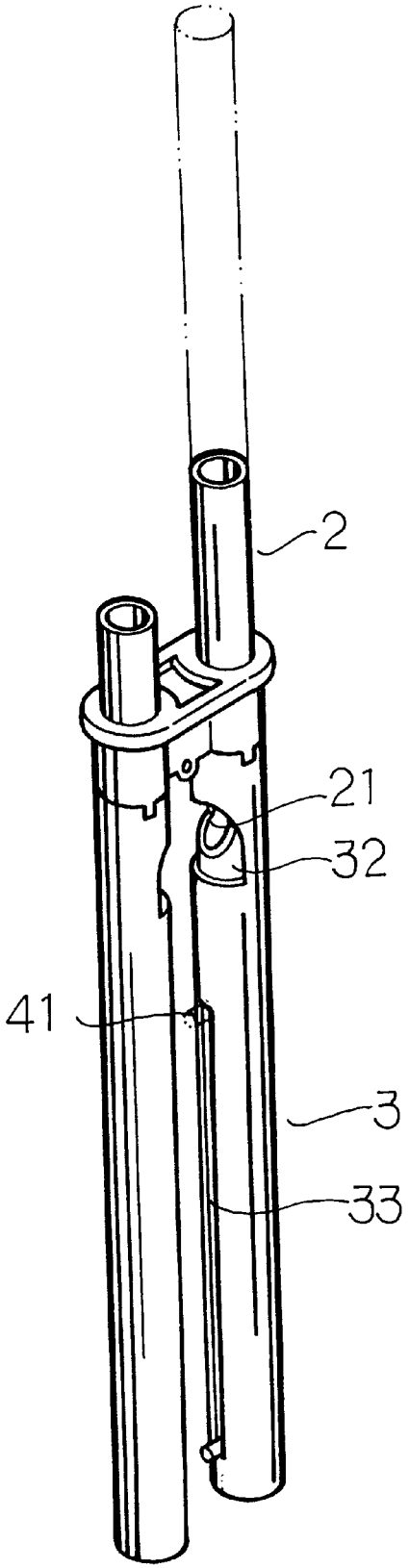
FIG. 2 shows a schematic view of the construction of the support tubes and the movable support rods of the support frame of the present invention.
Figure 3:
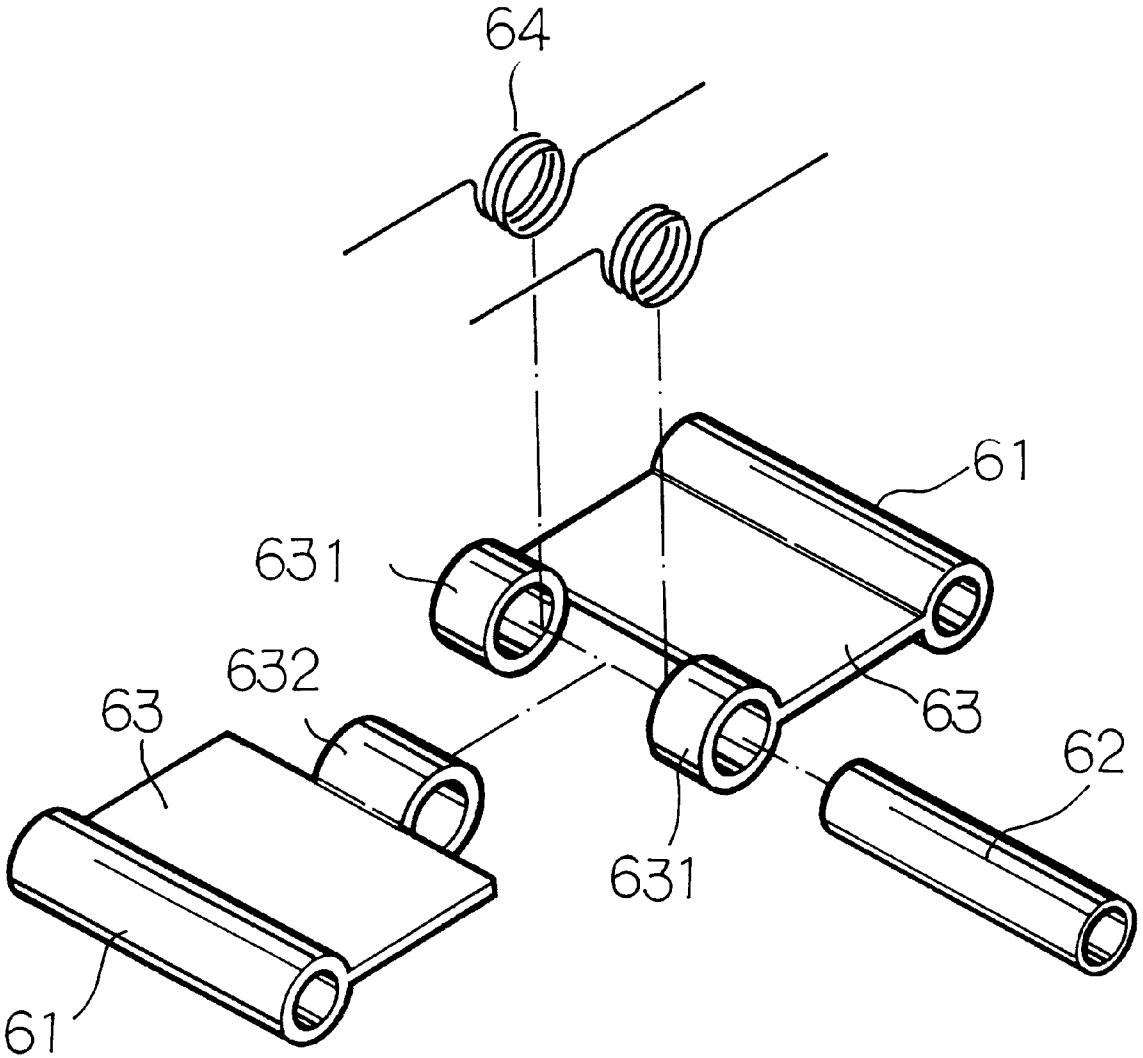
FIG. 3 shows an exploded view of the retaining member of the support frame of the present invention.
Figure 4:
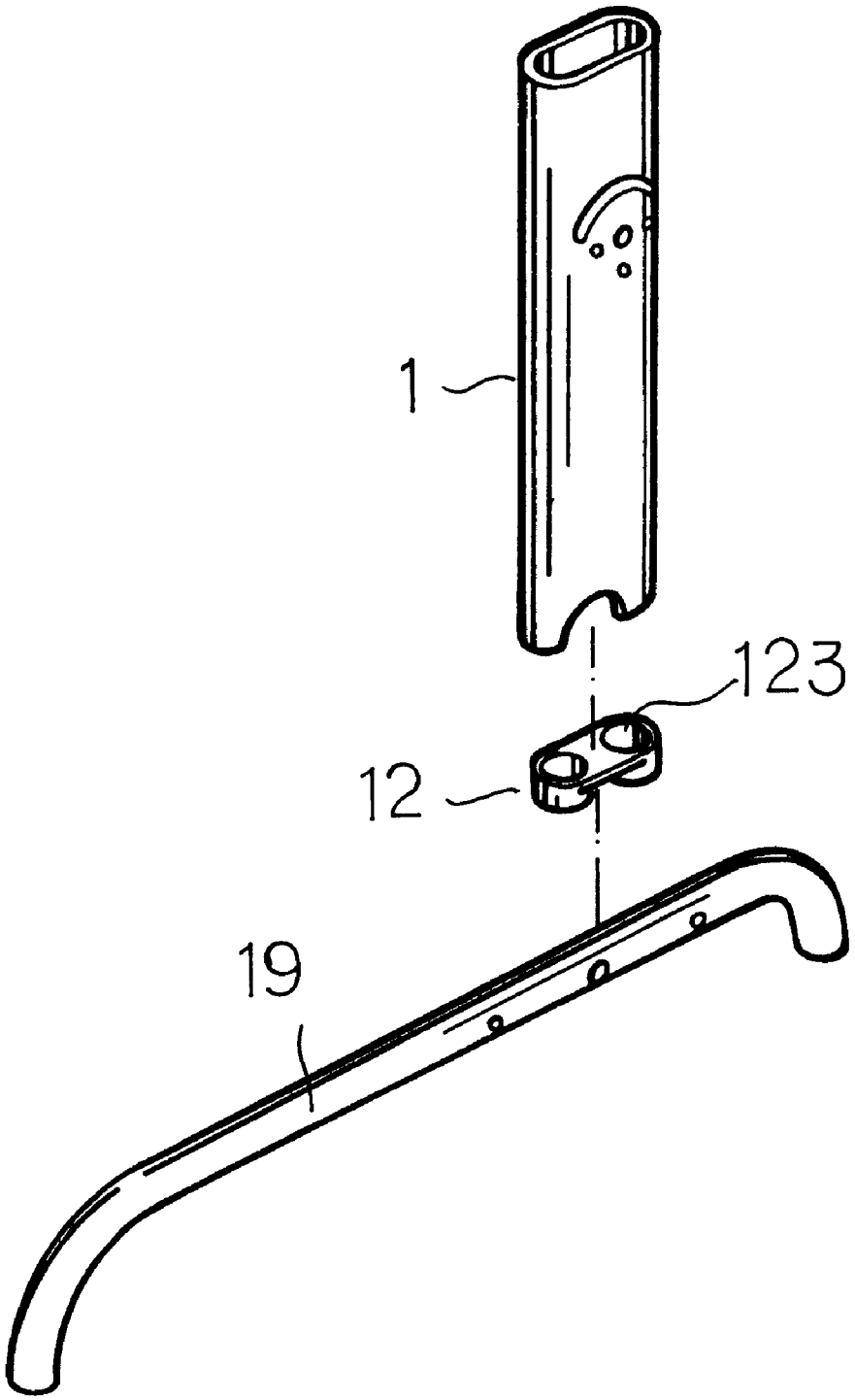
FIG. 4 shows a partial exploded view of the support frame of the present invention.

As shown in FIGS. 1–7, a computer desk embodied in the present invention consists essentially of two support frames, a main desk top (A), and an auxiliary desk top (B).

The two support frames are similar in construction to each other and are formed of a base tube 1, two movable support rods 2, two support tubes 3, two V-shaped elastic pieces 4, a fitting member 5, a retaining member 6, an adjustment shaft 7, two locating bolts 8, and an adjustment knob 9.

The base tube 1 is of a hollow construction and is provided at the bottom end thereof with two retaining portions and a connection piece 12 having two retaining slots 123 in which the two retaining portions of the bottom end of the base tube 1 are retained securely. The connection piece 12 is fastened securely with a caster mount 19 in conjunction with two protective covers 18. The caster mount 19 is provided respectively at both ends thereof with a caster 192 fastened pivotally therewith to facilitate the moving of the computer desk of the present invention on a floor surface. The two retaining portions of the base tube 1 are provided with a through hole (not shown in the drawings) in communication with the retaining slot 123 of the connection piece 12. The base tube 1 is provided correspondingly in two opposite side walls thereof with an arcuate hole 13 and a shaft hole 14. The base tube 1 is further provided in one of the two opposite side walls thereof with three locating holes 15, 16 and 17.

The two support tubes 3 are identical in construction to each other and are of a hollow construction. The two support tubes 3 are received in the hollow interior of the base tube 1 such that the bottom ends of the two support tubes 3 are retained securely in the retaining slots 123 of the connection piece 12 via the through holes of the two retaining portions of the bottom end of the base tube 1. Each of the two support tubes 3 is provided with a retaining slot 31, a locating hole 32, and a slide slot 33.

Figure 10:
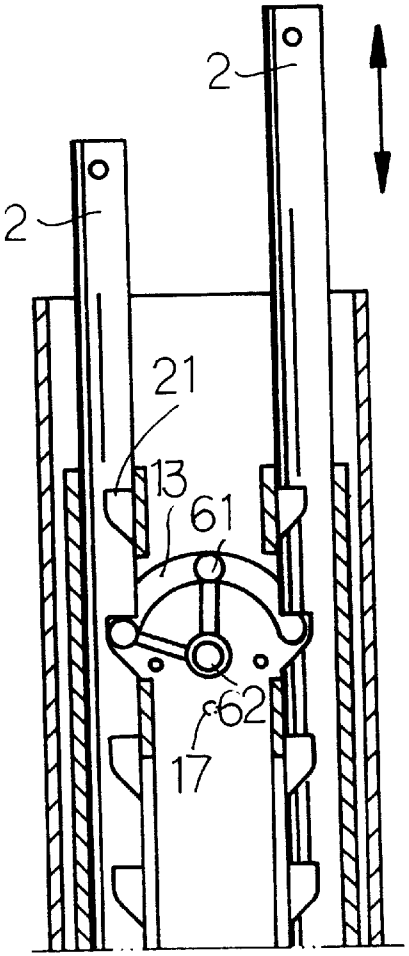
Figure 10:
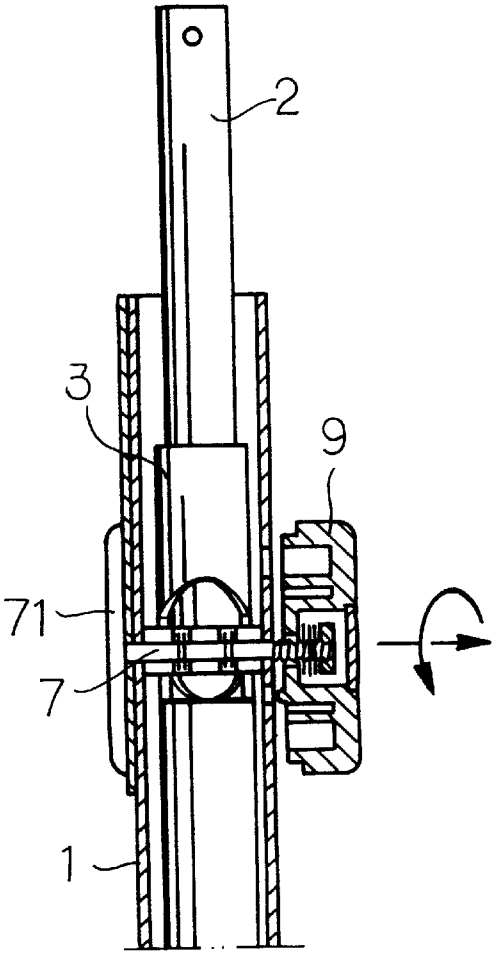
Figure 11:
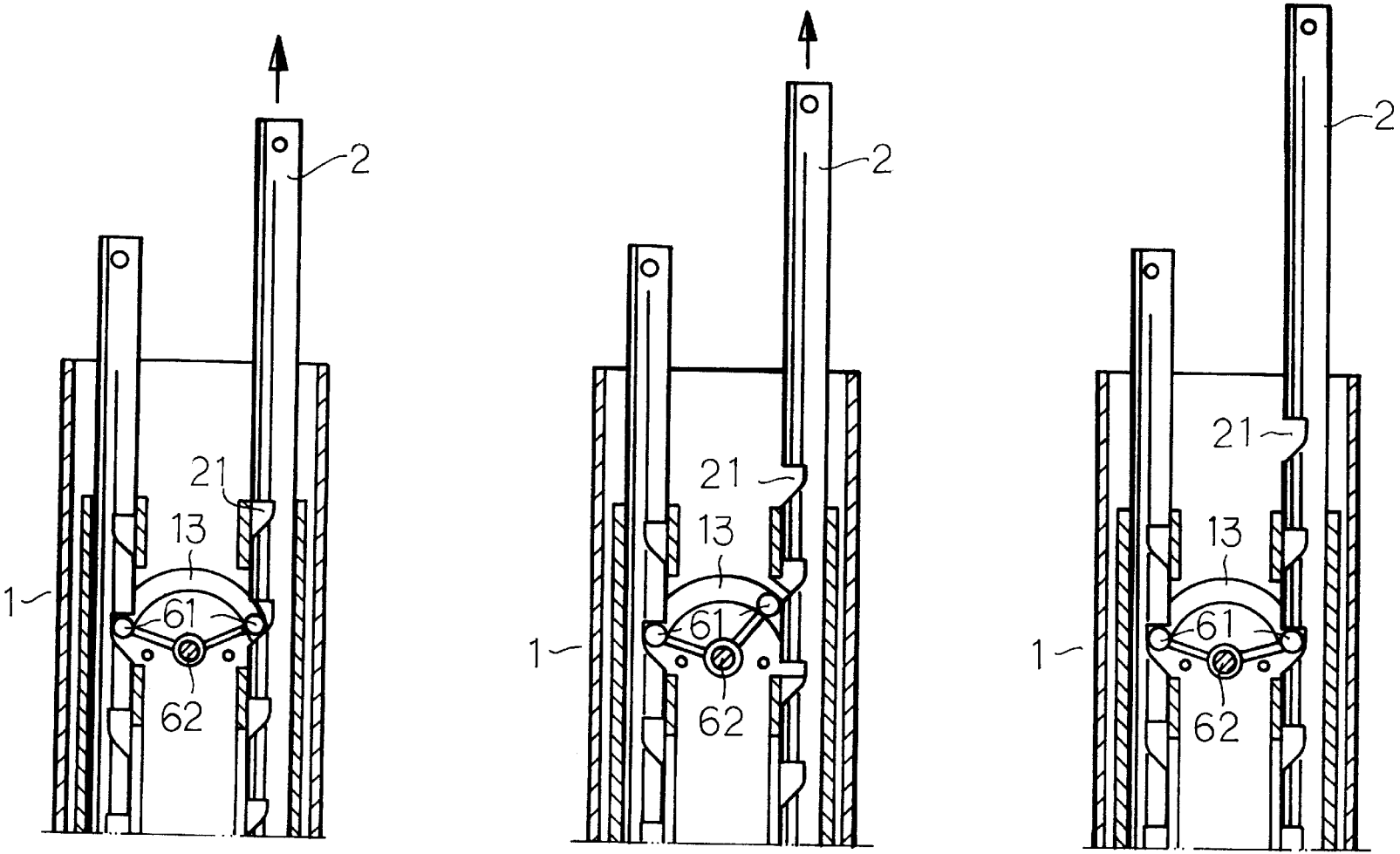

The two movable support rods 2 are of a hollow construction and are similar in construction to each other. Each of the two movable support rods 2 is provided with a plurality of retaining holes 21 which are arranged at an interval. The movable support rods 2 are further provided respectively at the bottom end thereof with an insertion hole 23, and the top end thereof with two bolt holes 24 opposite in location to each other. The retaining holes 21 are formed of a vertical wall and an inclined wall, as shown in FIGS. 10 and 11. One of the two movable support rods 2 is fastened with the main desk top (A) by a fastening bolt which is received in the bolt holes 24 of the top end of the movable support rod 2. Other one of the two movable support rods 2 is fastened with the auxiliary desk top (B) by a fastening bolt which is received in the bolt holes 24 of the top end of the movable support rod 2. The two movable support rods 2 are respectively received in the support tubes 3 in conjunction with the V-shaped elastic piece 4 which is located in the bottom end of the support tube 3 such that an arresting block 41 of the elastic piece 4 is inserted into the insertion hole 23 of the bottom end of the movable support rod 2. When the bottom end of the movable support rod 2 is located at the slide slot 33 of the support tube 3, the arresting block 41 is no longer confined such that it is located at the outside of the slide slot 33. The movable support rod 2 is prevented from being completely pulled out of the support tube 3 by the arresting block 41 of the elastic piece 4.

The fitting member 5 is provided in the upper side thereof with a cover piece 52 and two through holes 57 opposite in location to each other. The fitting member 5 is further provided in the underside thereof with a first arm 54 and a second arm 56, which are provided with a retaining block 51 and a through hole in communication with one of the two through holes 57. The fitting member 5 is fitted into the top end of the base tube 1 such that the arms 54 and 56 of the fitting member 5 are inserted into the top ends of the support tubes 3, and that the retaining blocks 51 of the two arms 54 and 56 are retained securely in the retaining slots 31 of the two support tubes 3, and further that the top ends of the two movable support rods 2 are jutted out of the fitting member 5 via the two through holes 57 of the fitting member 5.

The retaining member 6 is formed of two bodies 63, a pin 62, and two springs 64. The two bodies 63 are provided at one end thereof with a retaining portion 61. One of the two bodies 63 is provided at other end thereof with two fastening portions 631, whereas other one of the two bodies 63 is provided at other end thereof with a fastening portion 632. The two bodies 63 are joined together by the pin 62 which is fitted into the two springs 64 and is received in the fastening portions 631 and 632. The retaining member 6 is located between the two support tubes 3 such that the fitting member 6 is located in the two locating holes 32 of the two support tubes 3, and that the two retaining portions 61 of the fitting member 6 is retained in one of the retaining holes 21 of the movable support rods 2. The retaining portions 61 are provided with a through hole.

The adjustment shaft 7 is provided with a head 71 having grooves 712, and a threaded shank 72.

The adjustment knob 9 is provided with a shaft hole 91, grooves 92, and a locating block 93. The adjustment knob 9 is fastened with the base tube 1 by the adjustment shaft 7 in conjunction with a spring 97 fitted over the shank 72, and a shaft cover 99 engaged with the threaded shank 72. The adjustment shaft 7 is received in the shaft holes 14 of the base tube 1 and the shaft hole 91 of the adjustment knob 9. The adjustment knob 9 is fastened with the base tube 1 such that the adjustment knob 9 can be pulled slightly in the direction away from the base tube 1.

When the level of the main desk top (A) is to be adjusted, the adjustment knob 9 is slightly pulled in the direction away from the base tube 1 such that the locating block 93 is moved out of the locating hole 17, and that the adjustment knob 9 is turned counterclockwise to cause the retaining portion 61 of the retaining member 6 to disengage the front movable support rod 2, which can be then raised or lowered to a desired level. The adjustment knob 9 is turned back to its original position to cause the retaining portion 61 of the retaining member 6 to be once again retained in another one of the retaining holes 21 of the front movable support rod 2. As the adjustment knob 9 is then let go, the adjustment knob 9 is pulled back to join with the base tube 1 by the elastic force of the spring 97. As a result, the locating block 93 of the adjustment knob 9 is once again located in the locating hole 17 of the base tube 1.

The level of the auxiliary desk top (B) is adjusted by first pulling the adjustment knob 9 in the direction away from the base tube 1 before the adjustment knob 9 is turned clockwise such that the retaining portion 61 of the retaining member 6 is disengaged with the rear movable support rod 2 which is fastened with the auxiliary desk top (B). As a result, the rear movable support rod 2 can be thus raised or lowered to a desired level before the adjustment knob 9 is turned back such that the retaining portion 61 of the retaining member 6 is once again retained in another one of the retaining holes 21 of the rear movable support rod 2. Thereafter, the adjustment knob 9 is let go to enable the adjustment knob 9 to be pulled back to join with the base tube 1 by the elastic force of the spring 93. The locating block 93 of the adjustment knob 9 is once again located in the locating hole 17 of the base tube 1.

Figure 5:
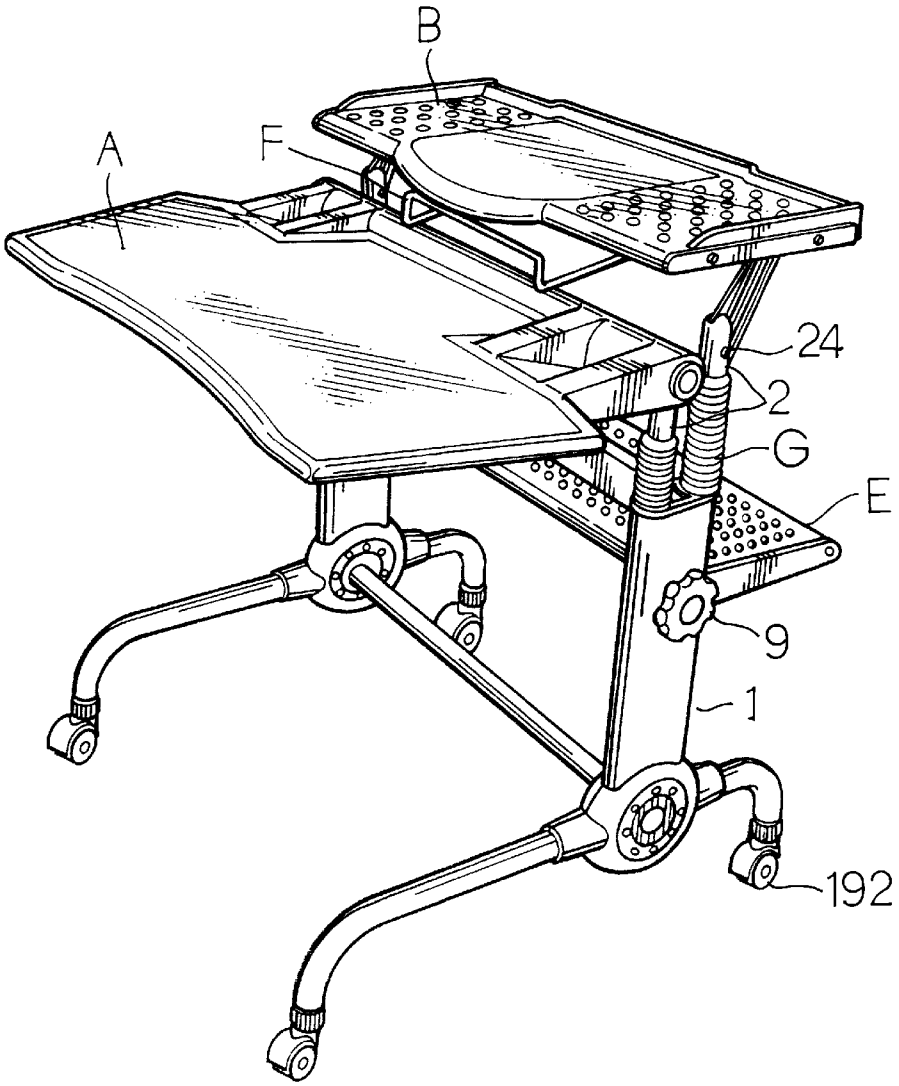
FIG. 5 shows a perspective view of the present invention.
Figure 6:
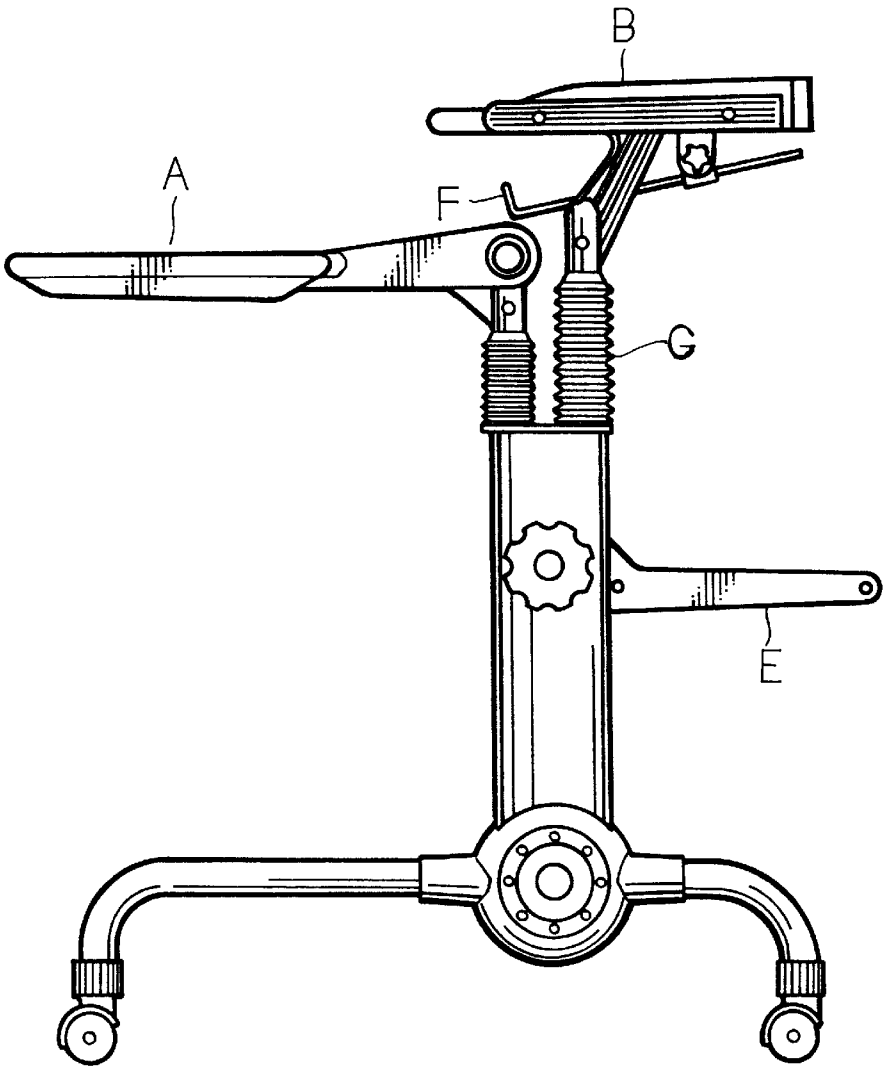
FIG. 6 shows a side view of the present invention.
Figure 7:
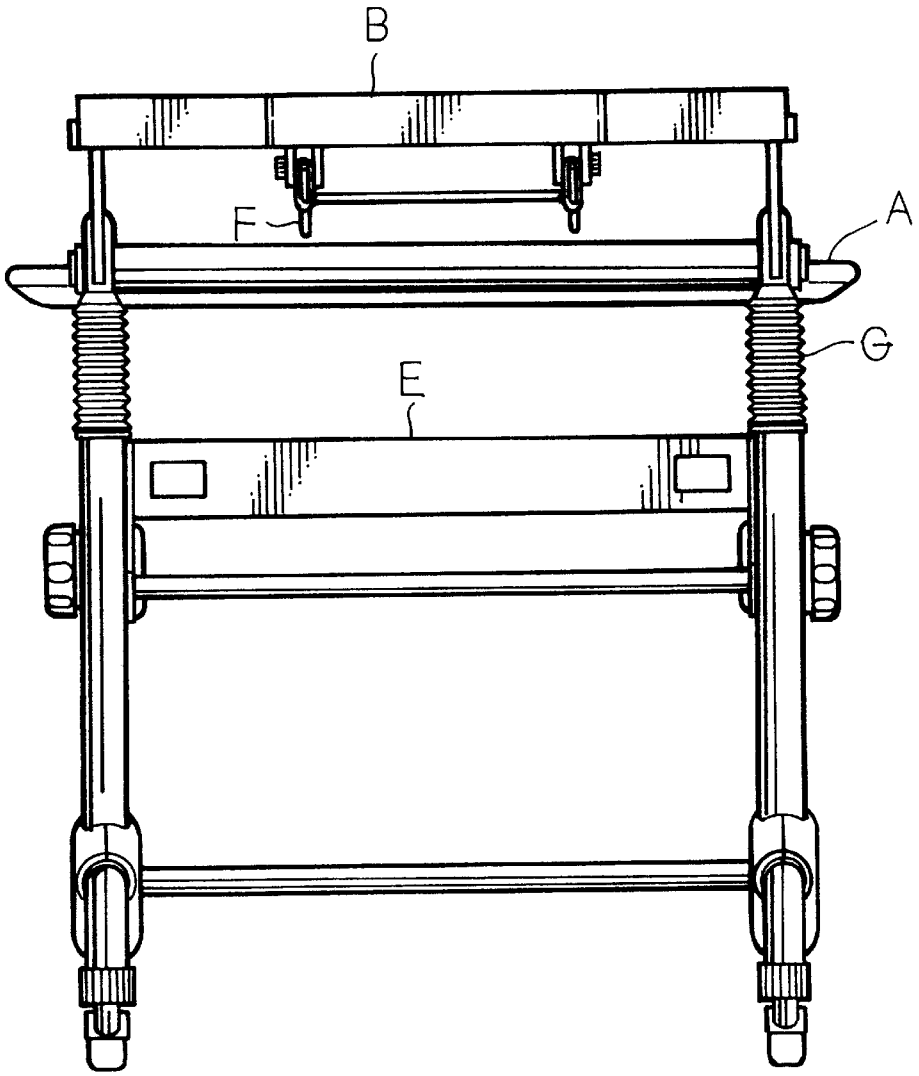
FIG. 7 shows a front view of the present invention.

As shown in FIG. 5, the computer desk of the present invention further comprises a rack (E) which is supported by two rack supports (C). Each of the two rack supports (C) is provided with two fastening holes C1 and C2 by which the rack (E) is fastened with the rack supports (C) in conjunction with the fastening screws. The rack support (C) is fastened with the base tube 1 by two locating bolts 8 which are received in the arcuate holes 13 of the base tube 1, the arcuate hole of the rack support (C), and the through holes of the retaining portions 61 of the retaining member 6 such that both ends of the locating bolts 8 are retained in the grooves 92 of the adjustment knob 9 and the grooves 712 of the head 71 of the adjustment shaft 7.

As shown in FIG. 5, the two movable support rods 2 are provided at the top end with a decorative cover (G) for enhancing the esthetic effect of the movable support rods 2.

Figure 8:
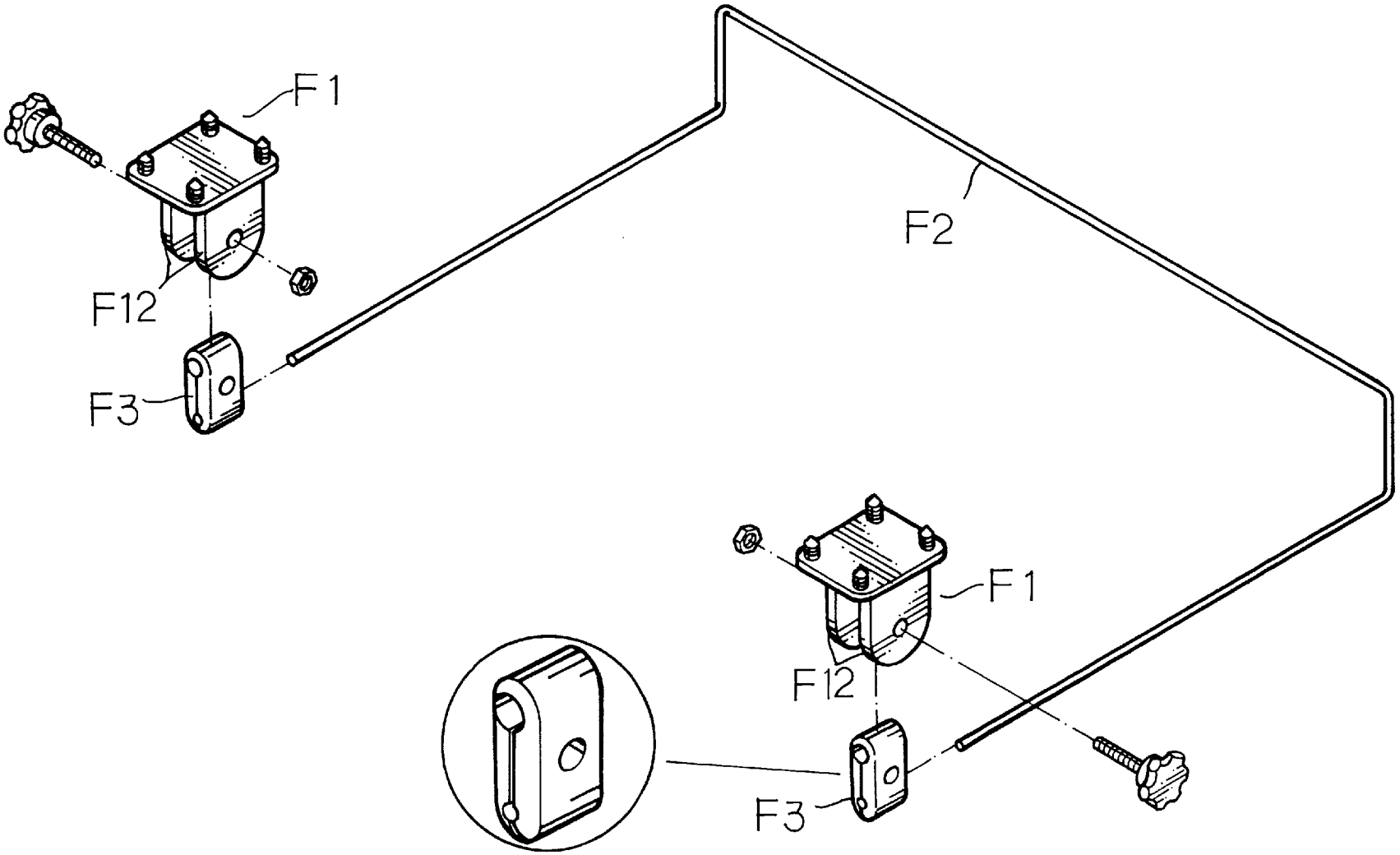
FIG. 8 shows an exploded view of a keyboard support of the present invention.
Figure 9:
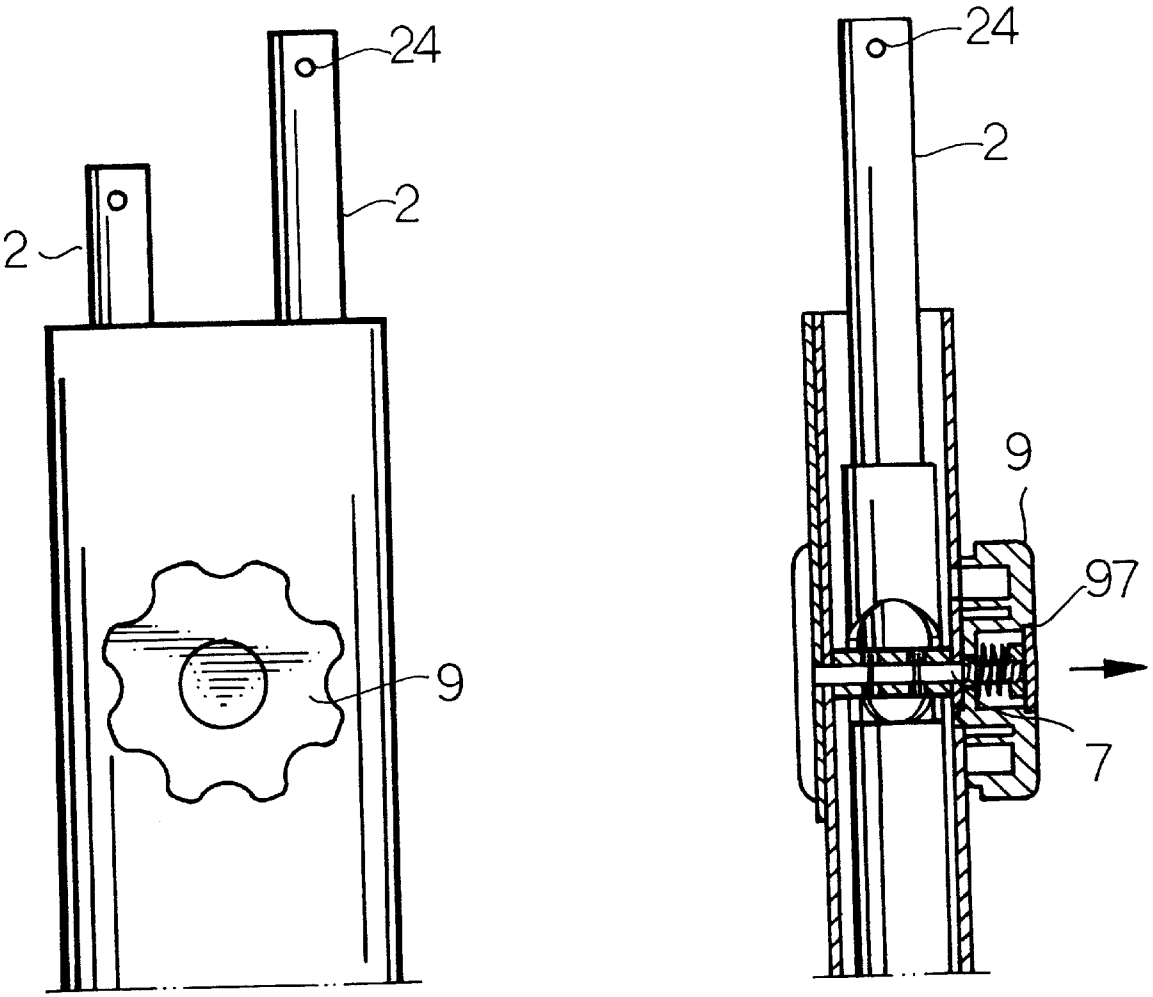
FIGS. 9–11 show schematic views of the ascending and the descending actions of the movable support rods of the present invention.

The computer desk of the present invention further comprises a keyboard support (F), which is located under the auxiliary desk top (B). The auxiliary desk top (B) is provided in the underside thereof with two clamping seats (F1) fastened therewith. As shown in FIG. 8, the two clamping seats (F1) are provided with two clamping pieces (F12) and a clamping member (F3) which is fastened between the two clamping pieces (F12) for holding a steel wire frame (F2). The keyboard support (F) is supported by the steel wire frame (F2) and is intended to store the keyboard of the computer at the time when the computer is not in use. As a result, the main desk top (A) can be kept clear for use as an ordinary desk.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A computer desk comprising:

two support frames;

an adjustable main desk top supported by said two support frames; and an adjustable auxiliary desk top supported by said two support frames;

wherein said two support frames are similar in construction to each other and are formed of:

a base tube of a hollow construction and provided at a bottom end with two retaining portions and a connection piece having two retaining slots in which said two retaining portions of said base tube are retained, said connection piece being fastened to a caster mount with two ends and with a pivotally fastened caster at each end of said caster mount, said base tube provided correspondingly in two opposite side walls with an arcuate hole and a shaft hole, said base tube further provided in one of said two opposite side walls with a plurality of locating holes;

two support tubes of a hollow construction and identical in construction to each other, said two support tubes being received in said base tube such that one end of each of said two support tubes is retained by said retaining slots of said connection piece via said through holes of said two retaining portions, said two support tubes provided with a retaining slot, a locating hole, and a slide slot;

two movable support rods of a hollow construction, said two movable support rods provided with a plurality of retaining holes, said two movable support rods further provided at one end with an insertion hole, and at other end with two bolt holes, one of said two movable support rods being fastened at said other end to said main desk top by a fastening bolt which is received in said bolt holes, the second of said two movable support rods being fastened at said other end to said auxiliary desk top by a fastening bolt which is received in said bolt holes, said two movable support rods being movably received in said two support tubes and a V-shaped elastic piece which is located in said one end of each of said support tubes such that an arresting block of said elastic piece is inserted into said insertion hole of said movable support rods, will prevent said movable support rods from being completely pulled out of said support tubes;

a fitting member provided in one side with a cover piece and two through holes, said fitting member having a second side with a first arm and a second arm, with said first arm and said second arm being provided with a retaining block and a through hole in communication with said two through holes of said one side of said fitting member, said fitting member being fitted into a top end of said base tube such that said first arm and said second arm of said fitting member inserted into said other end of said support tubes, and said retaining blocks of said first arm and said second arm are retained in said retaining slots of said two support tubes, and one of said two movable support rods extends through each one of said two through holes of said fitting member;

a retaining member formed of two bodies, a pin, and two springs, each of said two bodies provided at one end with a retaining portion, one of said two bodies provided at a second end with two fastening portions, other one of said two bodies provided a second end with a fastening portion, said two bodies being joined together by said pin which is fitted into said two springs and is received in said fastening portions, said retaining member being disposed between said two support tubes such that said retaining portions are removable located in said two retaining holes of said two support tubes and in one of said retaining holes of each of said movable support rods, said retaining portions provided with a through hole;

an adjustment shaft provided with a head having grooves, and a threaded shank extending from said head; and an adjustment knob provided with a shaft hole, grooves, and a locating block and said adjustment knob being fastened to said base tube by said adjustment shaft in conjunction with a spring fitted over said shank, and a shaft cover engaged with said threaded shank, said adjustment shaft being received in said base tube side wall holes and said shaft hole of said adjustment knob, said adjustment knob being fastened with said base tube such that said adjustment knob can be pulled in a direction away from said base tube and than turned counterclockwise to cause said retaining portion of said retaining member to be moved from said retaining hole in one of said two movable support rods so as to raise or lower said one of said two movable support rods to a desired level, said adjustment knob capable of being pulled in said direction away from said base tube before said adjustment knob is turned clockwise to cause said retaining portion of said retaining member to be removed from said retaining hole in said second movable support rod so as to raise or lower said other one of said two movable support rods to a desired level.

2. The computer desk as defined in claim 1, wherein said connection piece of said base tube is fastened with said caster mount in conjunction with two protective covers.

3. The computer desk as defined in claim 1, wherein said retaining holes of said movable support rods form a horizontal wall and an inclined wall.

4. The computer desk as defined in claim 1, wherein said two movable support rods are provided at one end thereof with a decorative cover fastened therewith.

5. The computer desk as defined in claim 1 further comprising a rack and two rack supports provided with an arcuate hole and a plurality of fastening holes for fastening said rack by a plurality of fastening screws which are engaged with said fastening holes, said rack supports being fastened with said base tube by two locating bolts which are received in said arcuate holes of said base tube, said arcuate hole of said rack supports, and said through holes of said retaining portions of said retaining member such that one end of each said locating bolt is retained in one of said grooves of said adjustment knob and said grooves of said head of said adjustment shaft.

6. The computer desk as defined in claim 1, wherein said auxiliary desk top is provided on an underside thereof with two clamping seats fastened therewith and provided with two clamping pieces and a clamping member which is fastened between said two clamping pieces for holding a steel wire frame; and wherein a keyboard support is supportable by said steel wire frame.

* * * * *